United States Patent [19]

Alderman

[11] Patent Number: 4,967,535

[45] Date of Patent: Nov. 6, 1990

[54] ROOFING APPARATUS AND METHOD

[76] Inventor: Robert J. Alderman, P.O. Box 4480, Marathon, Fla. 33050

[21] Appl. No.: 405,307

[22] Filed: Sep. 11, 1989

[51] Int. Cl.[5] ..... E04G 21/14

[52] U.S. Cl. ..... 52/749; 52/747; 52/407

[58] Field of Search ..... 52/747, 749, 748, 407

[56] References Cited

U.S. PATENT DOCUMENTS

| | | | |
|---|---|---|---|
| 3,969,863 | 7/1976 | Alderman | 52/407 |
| 3,983,676 | 10/1976 | Gilpin | 52/749 |
| 4,047,345 | 9/1970 | Alderman | 52/407 X |
| 4,047,346 | 9/1977 | Alderman | 52/407 |
| 4,075,807 | 2/1978 | Alderman | 52/407 |
| 4,078,355 | 3/1978 | Clemensen | 52/749 X |
| 4,147,003 | 4/1979 | Alderman | 52/407 X |
| 4,656,808 | 4/1987 | Mansfield | 52/749 |

*Primary Examiner*—David A. Scherbel
*Assistant Examiner*—Linda J. Hoffert
*Attorney, Agent, or Firm*—Thomas & Kerr

[57] ABSTRACT

Apparatus for applying flexible strips of insulation to purlins during the construction of a roof has a carriage 10, front and rear rollers 15, 16, a spindle 24 and a sheet support 30 that extends from the carriage in cantilever arrangement beneath the rear roller to a position between and along the top surface plane of the purlins to support the sheet material as the roof's constructed.

12 Claims, 1 Drawing Sheet

ROOFING APPARATUS AND METHOD

TECHNICAL FIELD

This invention relates to roofing methods and apparatus, and particularly to methods and apparatus for applying flexible sheet material to roofs of the type having purlins which support hard roofing materials.

BACKGROUND OF THE INVENTION

Roof structures of industrial buildings typically comprise roof or rafter beams which extend parallel to one another across the building in one direction and purlins mounted on the rafters which extend parallel to one another in directions normal to the rafters. Flexible vinyl material in sheet form is applied in strips to adjacent purlins so as to span the space between adjacent purlins. The vinyl forms a vapor barrier between the roof and the space in the building below the roof. The vinyl sheets are prevented from sagging into the space between adjacent purlins during roof construction by wires that are stretched between the purlins and which become a permanent part of the roof. The vinyl sheets are in turn overlaid with heat insulation material, such as fiberglass sheets, which in turn are covered with sheets of corrugated metal.

Examples of roof structures of this type and methods and apparatus for installing such structures are disclosed in my U.S. Pat. Nos. 3,559,914; 3,969,863; 4,047,345; 4,075,807 and 4,147,003.

As just stated, upon completion roofs of the type just described retain the network of wires that were mounted to the purlins for the purpose of preventing the strips of flexible insulation from sagging during roof construction. Once the roof is completed, however, these wires serve no purpose since the vinyl sheets and fiberglass insulation are then prevented from sagging by the fasteners that extend through the metal roof sheets, the fiber glass and the vinyl sheets into the purlins. Thus, though the support wires are useful in preventing the sheet material from sagging briefly during roof construction, they become superfluous after the roof structure has been completed. Furthermore, since the support wires are present throughout the roof they are quite costly to purchase and to install.

Accordingly, it is seen that were an apparatus and method to be devised for applying flexible sheet material to purlins during the construction of a roof without the need for wires of other permanent support structure to support the sheet material, a distinct advance in the art would be achieved. It is to the provision of such therefore that the present invention is primarily directed.

SUMMARY OF THE INVENTION

In a preferred form of the invention, apparatus for use in applying flexible sheet material to purlins in the construction of a roof comprises a mobile framework or carriage and means of supporting a roll of flexible sheet material for dispensation on the carriage. The apparatus has means for guiding sheet material dispensed from the roll onto a pair of mutually spaced purlins. The apparatus further has means mounted on the carriage for supporting a portion of flexible sheet material located between the purlins as additional roofing material is placed upon the purlins and sheet material during roof construction.

In another form of the invention a method is provided for constructing a roof of the type having pairs of spaced purlins. The method comprises the steps of moving a carriage along a pair of adjacent purlins in incremental steps and dispensing flexible sheet material carried on the carriage onto a succession of longitudinal portions of the purlins and successively supporting dispensed portions of the sheet material with support means mounted to the carriage in a carriage trailing position.

DETAILED DESCRIPTION

Figure 2:
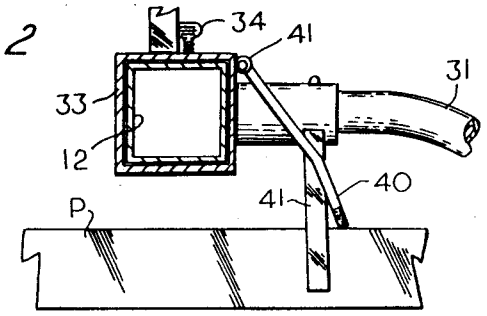
FIG. 2 is a side elevational view, shown partly in cross section, of a portion of the apparatus illustrated in FIG. 1.

Referring now in more detail to the drawing, there is shown apparatus for applying flexible sheet material such as vinyl sheet material from a reel supply, to purlins during construction of a building roof. The apparatus comprises a mobile framework or carriage, indicated generally at 10, that has a pair of side bars 11 rigidly held apart in mutually spaced, parallel relation by a crossbar 12 and a push bar 13. A front roller 15 is rotatably mounted to the front ends of the side bars 11 and a rear roller 16 is rotatably mounted to their rear ends. A cylindrical guide bar 17 is mounted to the side bars between, and parallel with, and axially coplanarly with the front and rear rollers. As the guide bar 17 has a diameter that is smaller than the diameter of the front and rear rollers, its bottom surface is elevated slightly above the bottom surfaces of the rollers.

The apparatus also has means for rotatably supporting and dispensing flexible sheet material 20 in strip or sheet form, from a roll 20, of the material. The roll support means comprises a pair of stanchions 22 mounted uprightly upon the pair of side bars 11 between the front roller 15 and the crossbar 12. A resilient, serpentine clip 23 is mounted to each stanchion which is configured to releasably receive and rotatably hold a spindle 24. A drag is provided to prevent free rotation of the spindle. It is in the form of a rubber strap 26 that mounted at each of its ends by tension springs to one of the side bars 11. The strap is looped over a pulley that is rigidly mounted to one end of the spindle in sliding, frictional engagement therewith. A ratchet and pawl, indicating generally at 28, is mounted to an end of the front roller 15 and to the front end of one of the side bars 11 for inhibiting movement of the roller 15 in one rotary direction, namely clockwise as viewed in FIG. 1.

The apparatus also has a sheet support indicated generally at 30 for supporting the flexible sheet material 20 at a position trailing the rear roller 16. This support means includes a U-shaped bar 31 that is mounted at its ends to two slide bars 33 which in turn are slidably mounted to the crossbeam 12 to accommodate roofs of different purlin spacings. The spacing between the parallel legs of the bar 31, i.e., its width, is slightly less than the spacing between the purlins. The positions of the slide bars are held fixed along the crossbeam by set screws 34. The ends of two parallel leg portions of the U-shaped bar 33 extend downwardly from the crossbeam 12 to a bend located beneath the guide bar and then along a plane extending parallel with the side bars 11 passing closely beneath the rear roller 16 to a distance spaced substantially from the rear roller. Here the two legs merge with a bight 35. In the region located to the rear of the rear roller 16, the support has a set of crossed members 37 arranged in a lattice or net formation. These members may be in the form of bars or stretched tape or wire or other suitable material sufficient for a continuous supporting surface for the sheet material. With the carriage mounted atop two purlins P, the top surface of the crossed members 37 is positioned substantially along the plane in which the top surfaces of the purlins are located. Thus, the sheet support 30 is supported by the carriage in cantilever arrangement so as to extend from the carriage back toward the position of the completed portion of the roof structure.

As best shown in FIG. 2, the apparatus also has a pair of brake bars 40 that are pivotably mounted by pivots 41 to the slide bars 33 so as to slidably rest upon the purlins P. A guide bar 42 is rigidly mounted to each brake bar in a position close beside the purlins to maintain the carriage properly upon the purlins and to prevent it from sliding laterally thereof.

As previously stated, the apparatus is used in the construction of a roof of the type which has a flexible sheet of material, such as vinyl, placed upon mutually spaced, parallel arranged purlins P which sheet is overlaid with a layer of more rigid material, such as fiberglass. The fiberglass in turn is overlaid with a sheet of metallic hard roofing material R.

In utilizing the apparatus to apply the sheet of flexible material the carriage 10 is placed upon a pair of purlins P with its front and rear rollers 15 and 16 rotatably supported upon them. A roll of the flexible sheet material is loaded on the carriage. This is done by passing opposite, exposed ends of the roll bearing spindle 24 into the open gap at the end of the clips 23, then over the top of the stanchions 22 and to the front thereof where they are seated in a detenting bulge in the serpentine shaped, resilient clips. Sheet material 20 is then paid off the roll 20', passed under the guidebar 17 over the top of the U-shaped rods 31 of the support 30 and underneath the roller 16 directly on top of the purlins. The distal end of the sheet material is secured to the end of the purlins.

Figure 1:
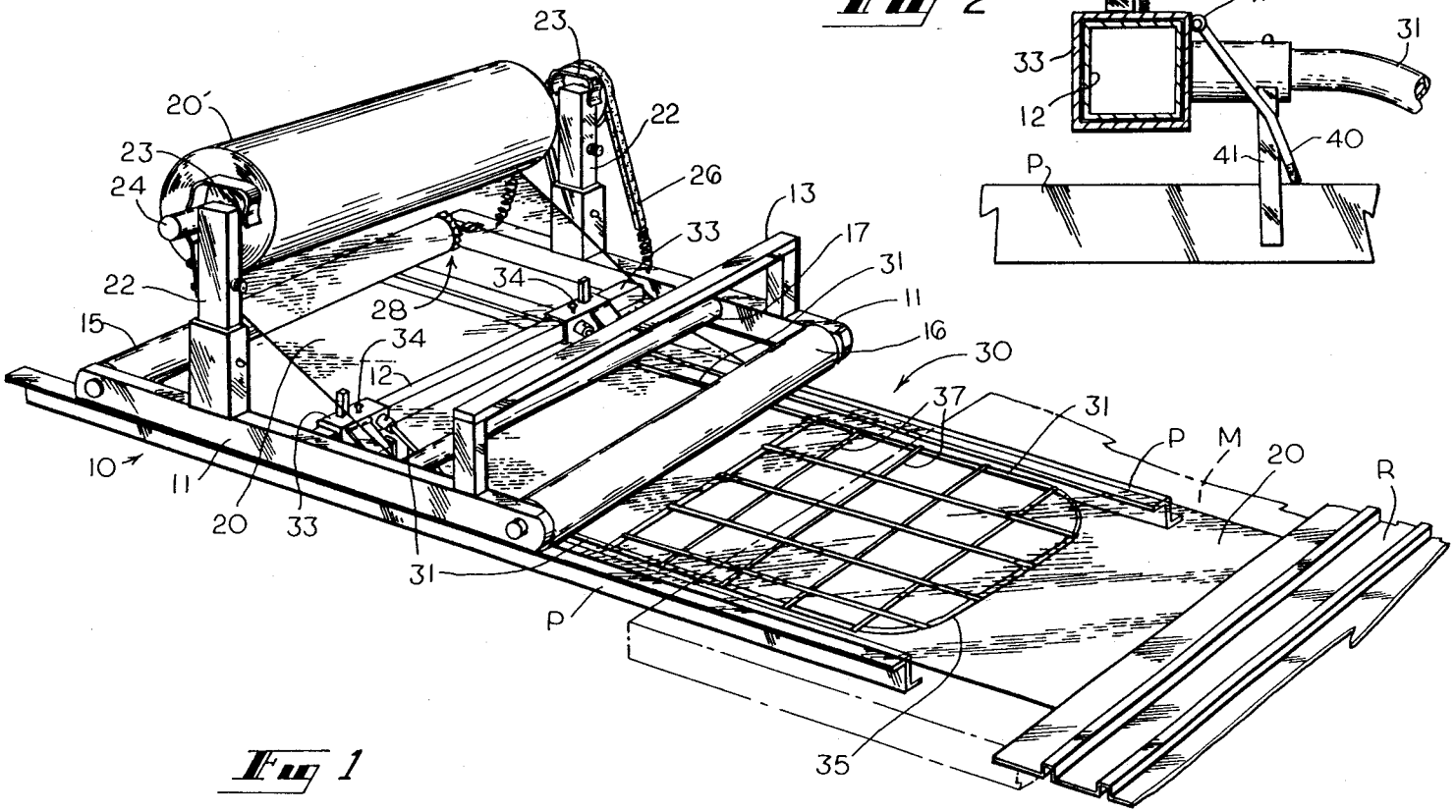
FIG. 1 is a perspective view of apparatus that embodies principles of the invention in a preferred form and which is shown in use applying a strip of flexible sheet material to a roof.

The apparatus is advanced along the purlins to the left, as viewed in FIG. 1, away from the completed segment of the roof structure, thereby causing the flexible sheet of material 20 to be paid out from the roll 20' onto the pair of purlins P. This is preferably done manually with the push bar 13 by a worker standing on the completed segment of the roof and pushing with a pole against the push bar 13. During this movement the carriage is guided on the purlins by the two guide bars 42 which function much as the inside flanges of train wheels do on a railroad track. During this movement of the apparatus it is prevented from backing up, under pull exerted on it by the sheet material, by means of the ratchet and pawl 28. Any small backing movement that might be permitted by the spacing between ratchet teeth is inhibited by the brake bars 40.

Movement of the carriage is continued until the rear roller 16 is located at a position beyond the width of the slab of relatively rigid overlaying material M that is to be placed upon the sheet material, as shown in FIG. 1. At this time it should be noted that the lattice or net-like portion of the sheet support means 30 is positioned between the purlins P with its upper surface oriented along the plane of the top of the purlins. Thus, at this point the sheet support means 30 prevents the flexible material 20 from sagging in the space between the purlins.

Next a slab or block of the more rigid material M, such as an elongated sheet of fiberglass, is placed upon the purlins P and flexible material 20, with the length of the sheet of fiberglass extending perpendicular to the lengths of the purlins. The side edge portions of the sheet material 20 in direct contact with the purlins thus become snugly sandwiched between the purlins and more rigid material M. Therefore at this point the flexible material becomes tautly held flushly to the bottom surface of the rigid material M and forms a vapor barrier over the tops of the purlins.

The support 30 is free to move with the carriage 10 and withdraws from beneath the finished part of the roof structure so as to assume a position beneath the next vacant space between the purlins. In the meantime, the vinyl sheet material pays out from the reel 20' as the carriage moves to its new position and the carriage holds the sheet taut while the next segment of the roof if being completed.

After the fiberglass insulation has been placed on the roof structure, the hard metal sheets of roofing material R are placed over the fiberglass and purlins, and fasteners are inserted through the metal sheets R, fiberglass sheets, vinyl sheets and through the upper surfaces of the purlins, so as to permanently anchor these elements together. In the meantime, the support 30 of the carriage 10 has assisted in supporting the several layers of material in place. Once the fasteners have been inserted, the carriage is pushed further out onto the purlins as by a worker standing on the hard roofing material and using a long pole to engage and push against push bar 13. This procedure is repeated until the roof structure is completed.

It thus is seen that an improved apparatus and method is now provided for applying flexible sheet material to purlins. Although the invention has been shown in a preferred form thereof, it should be understood that many modification, additions and deletions may be made thereto without departure from the spirit and scope of the invention as set forth in the following claims.

I claim:

1. Sheet material dispensing apparatus for use in progressively applying flexible sheet material to parallel mutually spaced purlins in the construction of a roof, said apparatus comprising a carriage for moving along the lengths of adjacent ones of the purlins of a roof structure, said carriage including roll support means for rotatably supporting a roll of flexible sheet material on said carriage for dispensation, guide means for guiding sheet material dispensed from a roll of material supported on said roll support means onto a pair of mutually spaced purlins beneath said carriage, and sheet support means mounted on said carriage for extending beneath and supporting a portion of the flexible sheet material extending from the roll of sheet material and spanning the mutually spaced purlins and extending away from the carriage back toward a previously completed segment of the roof structure as additional roofing material is placed upon the purlins and sheet material during roof construction, whereby the sheet material is progressively fed from a roll supported on the carriage beneath the guide means and over the sheet support means in response to the apparatus being moved along the purlins.

2. The apparatus of claim 1 wherein said guide means comprises a roller.

3. The apparatus of claim 2 wherein said sheet support means has a width less than said roller.

4. The apparatus of claim 3 wherein said roller has a width sufficient to span the pair of purlins and said sheet support means has a width sufficient to span the pair of purlins.

5. The apparatus of claim 1 wherein said sheet supporting means extends beneath said guide means.

6. The apparatus of claim 1 wherein said sheet support means is supported in a cantilever arrangement from said carriage.

7. Apparatus for use in progressively applying flexible sheet material to purlins in the construction of a roof as roof materials are applied to the purlins, said apparatus comprising a carriage having a pair of rollers for movably supporting said carriage upon a pair of spaced purlins having upper surfaces located in a common plane, means for supporting a reel of flexible sheet material upon said carriage for unrolling the free end of the reel onto the pair of purlins passing beneath one of said carriage rollers, and sheet support means mounted to said carriage and extending from the carriage beneath the sheet material toward the completed segment of the roof structure for supporting a portion of the sheet material generally along said common plane between the purlins.

8. The apparatus of claim 7 wherein said one roller has a width greater than the spacing between the purlins and said material portion support means has a width less than the spacing between the purlins.

9. The apparatus of claim 7 wherein said material portion support means extends beneath said one roller.

10. The apparatus of claim 7 further comprising ratchet and pawl means for preventing movement of at least one of said rollers in one rotary direction and a brake bar pivotably mounted to said carriage in a position to slide upon purlins at said common plane.

11. The apparatus of claim 7 and wherein said sheet support means is mounted in a cantilever arrangement to said carriage.

12. Sheet dispensing apparatus for use in progressively applying sheet material to adjacent parallel purlins during the construction of a roof wherein the sheet material is progressively applied to the purlins and the hard roofing material as subsequently applied to the sheet material and purlins, comprising:

a carriage for movably mounting on adjacent ones of the purlins of a roof structure, means for guiding said carriage along the lengths of the purlins, roll support means mounted on said carriage for rotatably supporting a roll of flexible sheet material on said carriage above the purlins on which said carriage is mounted, sheet material guide means for guiding the sheet material paid off of the roll which is supported on said carriage onto a pair of adjacent purlins on which said carriage is mounted with the edge portions of the sheet material contacting the adjacent purlins, sheet material support means mounted to said carriage for extending beneath said sheet material paid off of the roll toward the hard roofing material, said sheet material support means extending at the level of the purlins for supporting the unrolled sheet material at the level of the purlins, whereby the sheet material is progressively paid out from the roll of sheet material supported on the carriage in response to the carriage moving along the purlins and the paid out sheet material extending from the carriage to the hard roofing material is supported by the sheet material support means at the level of the purlins.

* * * * *